United States Patent [19]

Voldrich

[11] Patent Number: 5,009,184

[45] Date of Patent: Apr. 23, 1991

[54] BOAT COVERS

[76] Inventor: Thomas Voldrich, 1014 Brookview, Parma, Ohio 44134

[21] Appl. No.: 446,658

[22] Filed: Dec. 6, 1989

[51] Int. Cl.[5] ..... B63B 17/00

[52] U.S. Cl. ..... 114/361; 135/88

[58] Field of Search ..... 114/361, 343, 364, 351; 135/88, 102

[56] References Cited

U.S. PATENT DOCUMENTS

| | | | |
|---|---|---|---|
| 2,821,989 | 2/1958 | Shepard | 114/361 |
| 2,823,684 | 2/1958 | Sartori | 114/361 |
| 4,593,641 | 6/1986 | Adams et al. | 114/361 |
| 4,683,900 | 8/1987 | Carmichael | 114/361 |
| 4,716,919 | 1/1988 | Griffin | 135/88 |

*Primary Examiner*—Sherman D. Basinger
*Assistant Examiner*—Stephen P. Avila
*Attorney, Agent, or Firm*—J. Helen Slough

[57] ABSTRACT

A cover for use on a boat or small craft, comprising a cover which is a tension member, hold-down straps which are tension members, tubular framing. The tubular framing comprises a pair of support members for the cover mounted forwardly and rearwardly of the boat, a hinged connection disposed medially of the support members wherefor a center-spanning cover is created which is secured to the framing and the hinged connection and tensioned supports enables the cover to be adjusted for desired peak drainage and width adjustment.

5 Claims, 2 Drawing Sheets

BOAT COVERS

BACKGROUND OF THE INVENTION

1. Field of the Invention

This invention relates to a boat cover or top for protection from sun or rain particularly adapted for use on small craft and on small craft varying in beam widths, the cover providing drainage from side to side in the case of rain or water covering and quick and easy set-up and convenient on board storage.

2. Description of the Prior Art

In the prior art, notably a patent to Frieder U.S. Pat. No. 3,354,892 patented Nov. 28, 1967, a boat canopy is disclosed which consists in a covering for a supporting framework previously erected on the boat. The covering as shown, has an arch catenary with a peak portion along the center line and drains from side to side. The cover in Frieder, is placed over the frame and secured thereto by cables running through tunnels in joints in sections of the cover. U.S. Pat. No. 3,422,829 to Adams discloses a canopy support with an elaborately designed gunwale hinge to support the super-structure. Adams uses an adjustable center piece with various holes to adjust beam widths. Other prior art patents include U.S. Pat. No. 4,683,900 which discloses a canopy including two U-shaped support members pivotally interconnected at the ends adapted for coupling with the side rails of the vehicle (such as a boat, tractor, or the like); it utilizes rubber straps coupled with the support members for slideable coupling with the side rails. The canopy is collapsible upon impact. A later patent to Adams U.S. Pat. No. 4,593,641 utilizes a pair of laterally adjustable U-shaped tubular frame members hingedly secured together, at least one of the tubular members connected to or received within a socket of a universal mounting at each side of the boat. The socket is pivotally mounted on articulating brackets carried by a C-shaped clamp removeably clamped to each side wall of the boat spanning the gunwales. U.S. Pat. No. 3,696,409 to Koontz and Reese discloses a gutter drain in FIGS. 3 and 4 running fore-and-aft for discharge of the same. U.S. Pat. No. 3,955,228 discloses a boat shade comprising a cover and a frame formed of three inverted U-shaped components, two of these being secured to the third inverted U-shaped component on which they are vertically erected by their ends to the sides of the boat.

SUMMARY OF THE INVENTION

Applicant's invention consists of a pair of medially hinged end frames adapted to be secured to a boat affording framing for a top or tarp for covering said framing and the boat and affording uniform loading of the substantially horizontal portions of the framing and transmitting torsional loading to vertical members of the same. The invention comprises essentially four structural elements, the cover which is a tension member, the hold-down straps which are tension members, the tubular framing and a center span member to assist in side drainage and to hold the shape of the top. It is designed to cover boats of varying beam widths and eliminates drainage into the boat, the cover for the hinged frame forms a ridge along the centerline of the boat for side to side drainage.

DESCRIPTION OF THE PREFERRED EMBODIMENT

Figure 1:
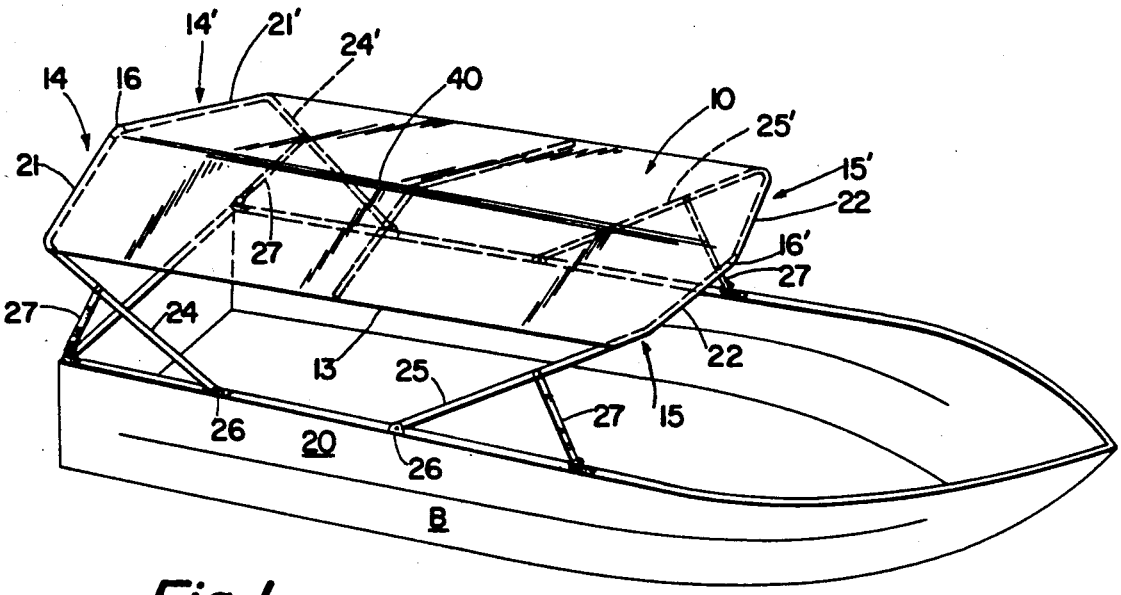
FIG. 1 is a perspective view illustrating a boat cover and framing for the cover shown mounted on a small boat.

The invention basically comprises three structural elements, a canopy comprising a cover or tarp 10, preferably formed of nylon, a frame preferably of aluminum tubing 11 formed from a pair of reversely L-shaped supports 14, 14', and 15, 15' mounted, as hereinafter described, on each end at the forward and rearward portions of a small boat "B". A vertically and outwardly projecting leg 24, 24', 25, and 25' of each of the supports 14, 14' and 15, 15' is preferably securely mounted on the side of the boat by means of swivel joints 29 to brackets 26 and by hold-down adjustable straps 27 secured by mounting means such as clips 33 secured to the gunwales or sides 20 of the boat. Horizontally extending support members 21, 21', and 22, 22' are connected at mid-center by a hinged connection 16, 16', wherefor the cover or tarp of the invention, when placed over the framing and secured thereover as by velcro 30, 31, as shown in FIG. 2, becomes essentially a tension member.

Figure 3:
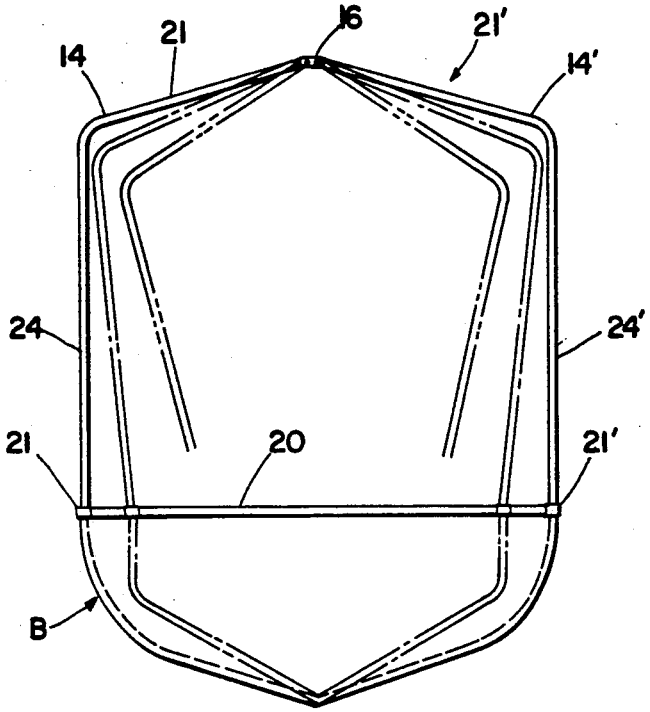
FIG. 3 is an end view of the tubular framing in several adjustment positions of the same.
Figure 4:
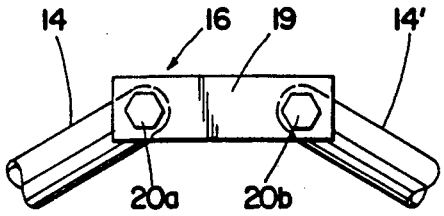
FIG. 4 is an enlarged fragmentary view showing a medial hinged connection for the cover connecting adjacent ends of each of several tubular frame members.
Figure 5:
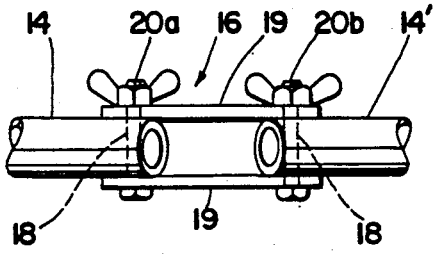
FIG. 5 is an enlarged top view of the hinged connection of FIG. 4.

The frame supports comprise, as shown both the substantially horizontally extending portions 21, 21', and 22, 22' and substantially vertically extending portions 24, 24', and 25, 25' which because of the hinged connection of pairs of the same, as shown in FIG. 3, and swivel joint and strap connection to the gunwales can be used on boats of different beam widths, as illustrated in FIG. 3. The downwardly extending ends of the legs or support members 24, 24' and 25, 25' of the frame are apertured as shown at 30 in FIGS. 6, 7, 8, and at 18 in FIGS. 4 and 5 to permit pins or bolts **20*a*, 20*b*, to project through the openings therein to secure the same to the gunwales and to secure the uppermost inwardly extending ends of the supports 14, 14', and 15, 15' to a pair of plates 19, 19' to form the hinged connection 16, 16' for the supports 14, 14' and 15, 15'**.

Figure 2:
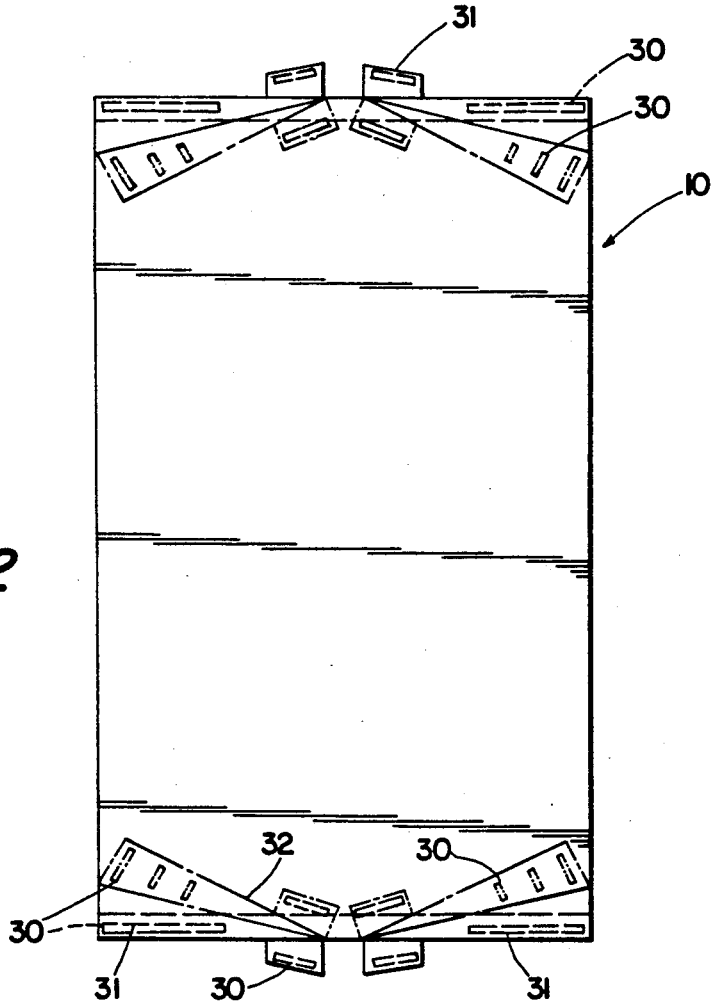
FIG. 2 is a top plan view of the unattached cover or tarp of FIG. 1.

The cover 10, as shown in FIGS. 1 and 2 takes on a hexagonal shape when attached to the frame, as shown in FIG. 1, owing to the hinged framing. After first placing of the frame on the boat to preliminarily secure the same thereto, the cover, forming a top for the frame, is secured thereto as by velcro loops 30 and velcro hooks 31 and thus wrapping the cover ends 32 directly over the tubing 21, 22, and 21' and 22' or securing the same thereto by other fastening means. The center span created by the securing of the cover to the framing and hinged connection of the support members and adjustable mounting on the boat enables the cover to drain from side to side when the velcro hooks are attached to the velcro loops and adjusted to exert desired tension on the cover allowing width adjustment of the cover as the frame undergoes mounting on the boat. The cover 10 is shown in one-piece, but preferably can be made of two straight pieces seamed longitudinally of the center span. As shown tabs are preferably placed on either side of the hinged connection 16, 16' to permit free movement of the frame about the hinged connection allowing the cover to have its dimensions altered which allows the cover to function as a tension member to create a peaked medial portion 40 wherefor the cover permits drainage of water, etc. from side to side of the cover. The cover can be detached therefrom or in place over the framing and folded for on board storage or the like. Alternatively the cover can be taken off of the members 24, 24' and 25, 25' and collapsed with members 21, 21' and 22, 22' still inside of the cover. The members 24, 24', 25, and 25' may be detached from the swivel joints and rolled up in the cover along with members 21, 21', 22, and 22' to form a compact cylindrically shaped bundle for storage. In use after the cover is secured to the frame, suitable adjustment of the covered frame by the swivel joint and hold-down strap connections velcro attachments and hinge position boat adapts the cover for use with any uncovered boat of different beam sizes.

The aluminum tube frame legs afford downwardly extending compression members 25 for substantially vertical portions of the frame and the generally horizontal portions are flexural members. This combined with the centerline hinge mechanism described above assists in adapting the cover for universal application for boats of varying widths.

Figure 6:
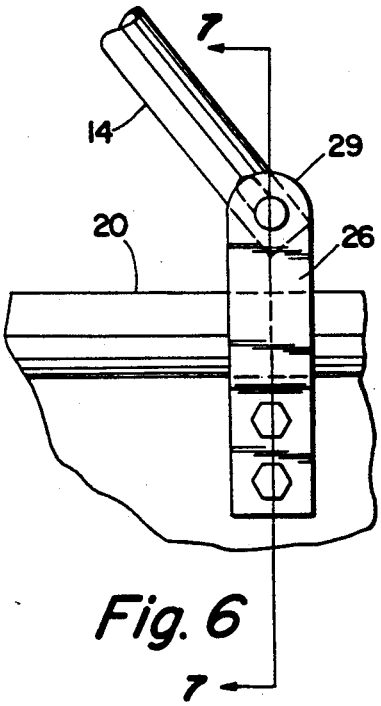
FIG. 6 is an enlarged fragmentary view showing attachment of a substantially angled downwardly extending end of the tubular framing to the gunwales.
Figure 7:
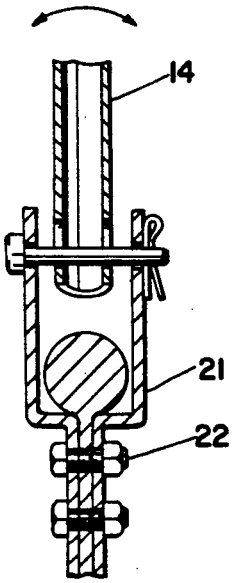
FIG. 7 is a sectional view taken from the line 7—7 of FIG. 6.
Figure 8:
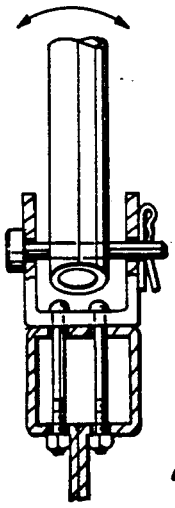
FIG. 8 is a sectional view similar to that of FIG. 7 showing a different means for securing the tubular framing to the gunwales.
Figure 9:
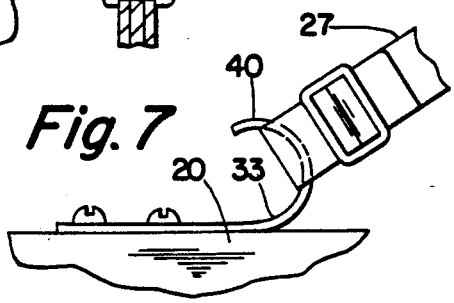
FIG. 9 is a fragmentary view of a strap connection of the cover and the securement of same to the gunwale.

The members 24, 24' and 25, 25' it will be apparent work against each other to create a truss effect held in equilibrium by the internal forces built up by the installers' adjustment of the tension straps 27 as shown in FIG. 3. The horizontal portions 21, 21' and 22, 22' of the frame are acted upon by the uniform loading of the cover or tarp 10 in the horizontal direction and by downward acting reactions in the hold-down straps 27 to create a point of maximum bending of the mounting of the tubular frame elements at the hinge connection 16, 16' as shown in FIGS. 1, 3, 4, and 5 and the hinged connection is built sufficiently strong to resist bending. The downwardly extending ends of the support 14, 14' as best shown in FIGS. 6 and 7 are provided with a slot 41 adjacent the downwardly extending ends thereof and space is provided between the said supports and the brackets 42 on the gunwale to allow for side to side movement of the supports.

Applicant's invention, simply put, involves cover or tarp 10, as shown in FIG. 1, over the framing securing the same thereto, the framing affording a hinged support for the cover which cover peaks at the center by virtue of the center hinge connection and the tarp is tensioned by hold-down straps secured to the boat and due to the compressibility and flexibility of downward portions of the frame (depending on the width of the beam of the boat), the downwardly extending portions of the tubular frame are substantially angled with respect to the tubular leg of the support to which it is hingedly connected, as best shown in FIG. 3, to give the framing the width it requires to accommodate the beam size of the boat in which it is mounted.

While I have described my invention in connection with a preferred embodiment, it is to be understood that numerous and extensive departures may be made therefrom without however departing from the spirit of my invention and the scope of the appended claims.

What I claim:

1. A canopy for an open boat comprising a frame, the frame consisting of a pair of reversely L-shaped fixed angled tubular supports mounted on either side of the boat said supports having substantially horizontal and substantially vertical portions, means for connecting the supports to opposite sides of the boat, which accommodates a swiveling action about the gunwale and about the transverse axis of the boat, a hinged connection connecting each pair of supports, a cover being disposed over the supports and functioning as a member of the frame for frame support, the said hinged connection providing peaking at the centerline of the cover to afford side to side drainage of water.

2. A canopy as claimed in claim 1 wherein adjustable means including the hinged connection are provided to secure the substantially vertical portions of the supports to gunwales of the boat to accommodate beam dimensions of varying sizes.

3. A canopy for an open boat comprising a frame, said frame consisting of a cover, straps, L-shaped support members and hinge plates, means for adjustably securing the L-shaped members to opposite side of the boat, a pair of said L-shaped support members with fixed angles being mounted both forwardly and rearwardly of the boat, each of horizontal portions of the supports of the frame creating torsional loading and transmitting such loading to the vertical portions resisted by adjustably securing the vertical portions to the boat, the cover detachably secured to the frame and functioning as a horizontal tension member of the frame.

4. A canopy as claimed in claim 3 wherein the cover is attached to horizontal hinged frame supports by adjustable fasteners wherefor the cover changes in heighth and other dimensions as the frame undergoes adjustment.

5. The cover and frame as claimed in claim 3 wherein the cover is tensioned creating a point of maximum bending movement at the medial hinged portions.

* * * * *